United States Patent [19]

Anav

[11] 4,254,556

[45] Mar. 10, 1981

[54] PORTABLE DRAFTING DEVICE FOR DRAWING PARALLEL LINES, COMPRISING A WORKING PLANE OF FLEXIBLE PLASTIC MATERIAL, ADAPTED TO BE ROLLED

[76] Inventor: Lello Anav, No. 35, Via Filippo Marchetti, Rome, Italy

[21] Appl. No.: 33,643

[22] Filed: Apr. 25, 1979

[30] Foreign Application Priority Data

May 3, 1978 [IT] Italy ..... 49187 A/78
Nov. 28, 1978 [IT] Italy ..... 52102 A/78

[51] Int. Cl.[3] ..... B43L 5/00
[52] U.S. Cl. ..... 33/437; 33/443; 108/27
[58] Field of Search ..... 33/430–447, 33/403, 479, 1 B, 1 G; 108/27; 35/61

[56] References Cited

U.S. PATENT DOCUMENTS

| | | | |
|---|---|---|---|
| 184,541 | 11/1876 | Minehart | 35/61 |
| 196,636 | 10/1877 | Cushman | 35/61 |
| 328,525 | 10/1885 | Shaver | 33/437 |
| 1,290,343 | 1/1919 | Posner | 33/430 |
| 2,623,324 | 12/1952 | La Barber | 33/430 |

FOREIGN PATENT DOCUMENTS

| | | | |
|---|---|---|---|
| 19488 | of 1911 | United Kingdom | 33/430 |

*Primary Examiner*—Charles E. Phillips
*Attorney, Agent, or Firm*—Beveridge, De Grandi, Kline & Lunsford

[57] ABSTRACT

A portable drafting device for drawing parallel lines, consisting of a rectangular flexible plastic material, two guides applied each on one of the short sides of the board, at least one slider adapted to slide on one of said guides, a rule fastened to at least one slider to slide therewith above said board for drawing parallel lines, said board being capable to be rolled into a roll for rendering it easily transportable.

7 Claims, 8 Drawing Figures

FIG. 5
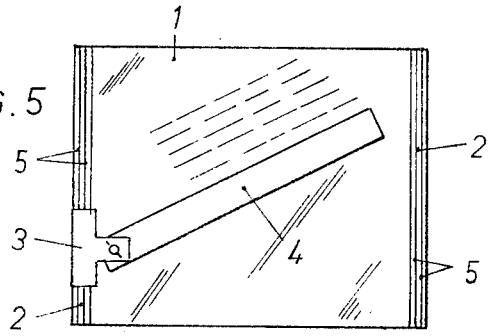
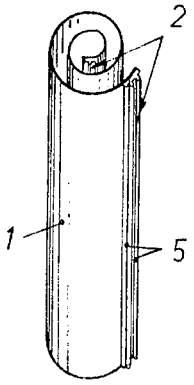
FIG. 8
FIG. 6
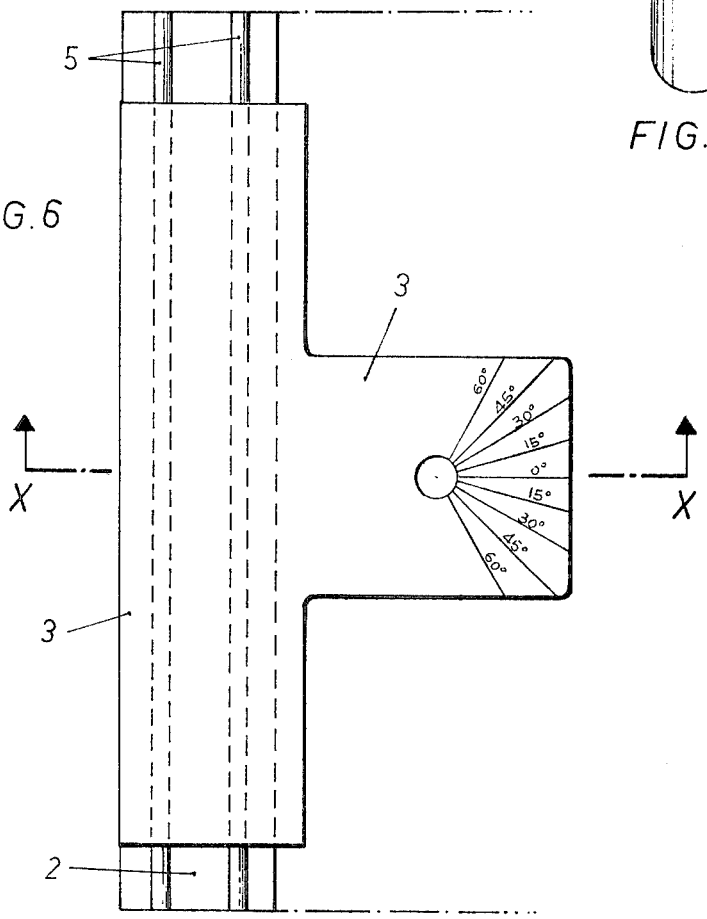
FIG. 7
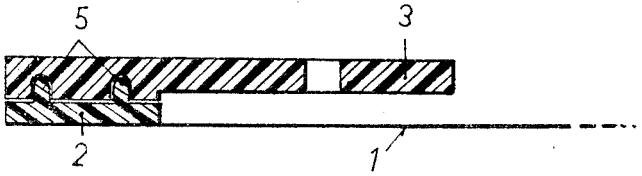

PORTABLE DRAFTING DEVICE FOR DRAWING PARALLEL LINES, COMPRISING A WORKING PLANE OF FLEXIBLE PLASTIC MATERIAL, ADAPTED TO BE ROLLED

The purpose of the present invention is to provide a portable drafting device which is adapted for drawing parallel lines and which is easily transportable and may be rolled into a roll having small overall dimensions.

The device substantially consists of a rectangular flexible plastic sheet having a desired size and carrying on each of its two parallel shorter sides a guide element, on at least one of which a slider is placed for sliding along said guide.

In the case in which there are provided two sliders, each on one of said guides, said sliders are rigidly connected each with one end of a drawing rule. By displacing with one hand said rule it may displace only parallely to itself owing to the sliders sliding along said guides.

There are known drafting boards of wood or plastic having suitable instruments for drawing parallel lines at any inclination angle. However these boards have the same overall dimensions as the drawing sheet and, besides their high cost, they have the disadvantage that they are inconvenient to transport.

The purpose of the present invention is to provide a sufficiently rigid smooth board, such to allow an optimal execution of drawings, which is provided with means coupled thereto for drawing parallel lines at any inclination angle. Moreover, said board is sufficiently flexible to be rolled on itself, thus reducing its overall dimensions during carrying.

Thus, the main advantage of the device according to the present invention consists in that after having removed the drawing rule, the flexible plastic board may rolled to form a narrow cylindrical roll.

This device is particularly useful for students of technical sciences at any degree, who may easily transport the rolled board and unroll it on the form or on any flat table.

The drawing board is preferably made of a transparent plastic so as to allow copying already performed drawings on tracing paper by superposing the board on the drawings to be copied.

The drafting device according to the present application will be now disclosed with reference to the attached drawings showing two preferred, but not limitative, embodiments of the invention.

In the drawings:

FIG. 5 shows in top view the drafting board consisting of a plastic sheet having a guide on each short side thereof, a slider on said guide and a rule connected at its one end to said slider;

FIG. 6 shows in top view a guide along which may slide a slider provided with a goniometer;

FIG. 7 shows a sectional view along the line X—X of FIG. 6;

FIG. 8 shows a perspective view of the plastic board rolled to form a cylindrical roll.

Figure 1:
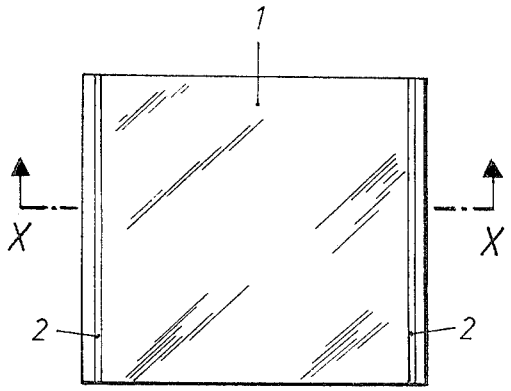
FIG. 1 shows in top view the drafting board consisting of a plastic sheet.
Figure 2:
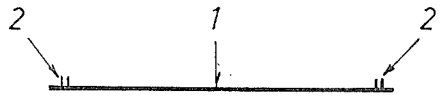
FIG. 2 shows a section along the lines X—X of FIG. 1.
Figure 3:
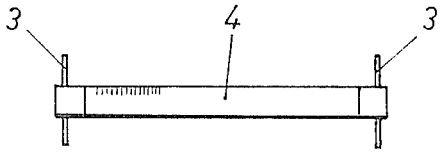
FIG. 3 shows a millimeter rule with sliders rigidly connected therewith.
Figure 4:
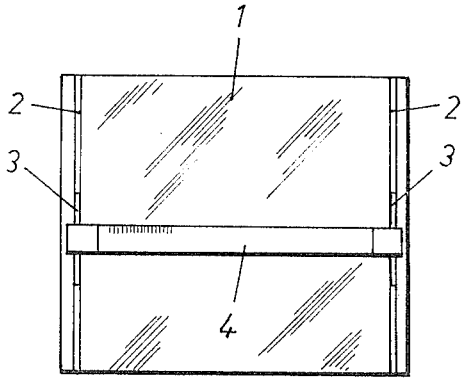
FIG. 4 shows in top view the entire drafting device according to the first embodiment thereof.

As may be noted in FIGS. 1 to 4, on a plastic board 1, preferably made of a transparent plastic material, which should be flexible but sufficiently rigid, a guide 2 is applied to the shorter board sides, on each of said guides a slider 3 being slidably arranged.

Said sliders 3 are connected to one another by a rule 4, preferably provided with a millimeter scale, which rule may be thus displaced, parallel to itself for drawing parallel lines.

In FIGS. 5 to 7 is shown a second embodiment of the invention. Also in this case the guides 2 are fastened to the shorter sides of the plastic board, but have two parallel linear rails 5 on which is slidably arranged a slider 3 having two grooves into which enter said rails so as to attain a greater stability of the cursor on the guide. A rule 4 is fastened by means of a knob screw to the slider 3 which is provided with a goniometer or protractor so as to select a desired inclination of the rule 4 and draw lines inclined at a desired angle.

For drafting lines on the portion of the board not covered by the length of the rule 4, it is sufficient to remove the slider with the rule and place it on the opposite guide.

The drafting device according to the present invention may be easily transported from one place to another by removing the cursor or cursors with the rule and rolling thereon the flexible board, thus reducing the size of the entire device to a narrow cylinder, as shown in FIG. 8.

Having thus described the present invention, what is claimed is:

1. A portable drafting device for drawing parallel lines comprising in combination a rectangular board of a flexible plastic material, two upstanding lateral guides, one of said guides on each of the two short parallel sides of the rectangular board, a slider member having means adapted to engage and slide on one of said guides, a rule member, means for fastening one end of said rule member to said slider member to slide therewith on the engaged guide above said board while permitting pivoting of said rule member about said fastening means in a plane parallel with said rectangular board, for drawing parallel lines having any desired inclination, the assembly formed by said slider member and rule member being freely disengagable from one guide and engagable with the other guide to permit drawing parallel lines on the board portion adjacent said other guide, each of said guides and said slider member having two parallel mutually engagable sliding elements to provide greater stability of said slider member when engaged with one of said guides, said board being adapted to be rolled around one of said guides to form a readily transportable roll.

2. A portable drafting device as claimed in claim 1, wherein said slider member has a protractor formed thereon for indicating the inclination of said rule member.

3. A portable drafting device as claimed in claim 1 or 7, wherein said parallel sliding elements consist of two linear rails provided on said guides and two grooves in said slider member with which said rails engage.

4. A portable drafting device as claimed in claim 3, wherein said board consists of a transparent material to permit copying drawings placed under said transparent board.

5. A portable drafting device as claimed in claim 1 or 7, wherein said board consists of a transparent material to permit copying drawings placed under said transparent board.

6. A portable drafting device for drawing parallel lines comprising in combination a rectangular board of a flexible plastic material, two upstanding lateral guides, one of said guides on each of the two short parallel sides of the rectangular board, two slider members, each of said slider members having means adapted to engage and slide on one of said guides, a rule member, means fastening each end of said rule member to one of said slider members to slide therewith on the engaged guides above said board for drawing parallel lines, each of said guides having two surfaces which extend parallel to each other, each of said slide elements having two surfaces which extend parallel to each other and are slidably engaged with said parallel surfaces on their respective guides to provide greater stability of said slider members when engaged with said guides to form a readily transportable roll.

7. A portable drafting device as claimed in claim 6, wherein said board consists of a transparent material to permit copying drawings placed under said transparent board.

* * * * *